United States Patent [19]

Schechter et al.

[11] Patent Number: 4,796,012

[45] Date of Patent: Jan. 3, 1989

[54] PERIMETER SURVEILLANCE SYSTEM WITH SECTIONAL INHIBITION

[75] Inventors: Mordechai Schechter, Rehovot; Moshe Barkay, Rishon LeZion, both of Israel

[73] Assignee: LEV Advanced Detection Systems Ltd., Rehovot, Israel

[21] Appl. No.: 31,485

[22] Filed: Mar. 27, 1987

[30] Foreign Application Priority Data

Mar. 31, 1986 [IL] Israel ..... 78355

[51] Int. Cl.[4] ..... G08B 13/22

[52] U.S. Cl. ..... 340/551; 340/506; 340/541

[58] Field of Search ..... 340/551, 541, 506, 501, 340/500, 587

[56] References Cited

U.S. PATENT DOCUMENTS

Re. 32,468 8/1987 Le Nay et al. ..... 340/506

*Primary Examiner*—Glen R. Swann, III

*Attorney, Agent, or Firm*—Townsend & Townsend

[57] ABSTRACT

An improved perimeter surveillance system employs multiple intrusion sensors distributed in the field and amplifiers associated therewith. Apparatus is provided for selectably inhibiting an alarm indication from a given sensor in response to electromagnetic interference detected thereat without necessarily inhibiting the operation of alarm indications from other sensors.

7 Claims, 18 Drawing Sheets

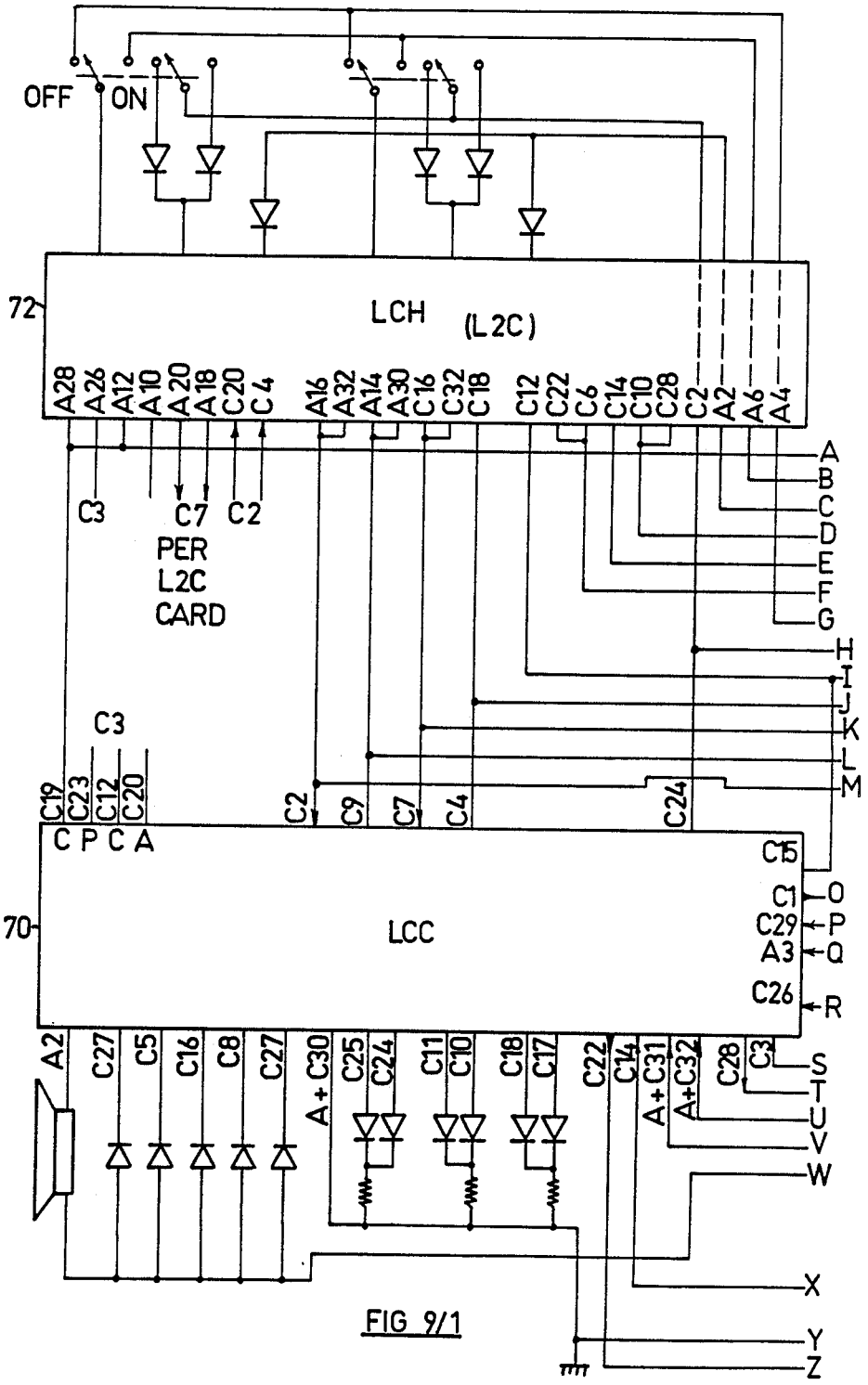
FIG 9/1

FIG 9/2
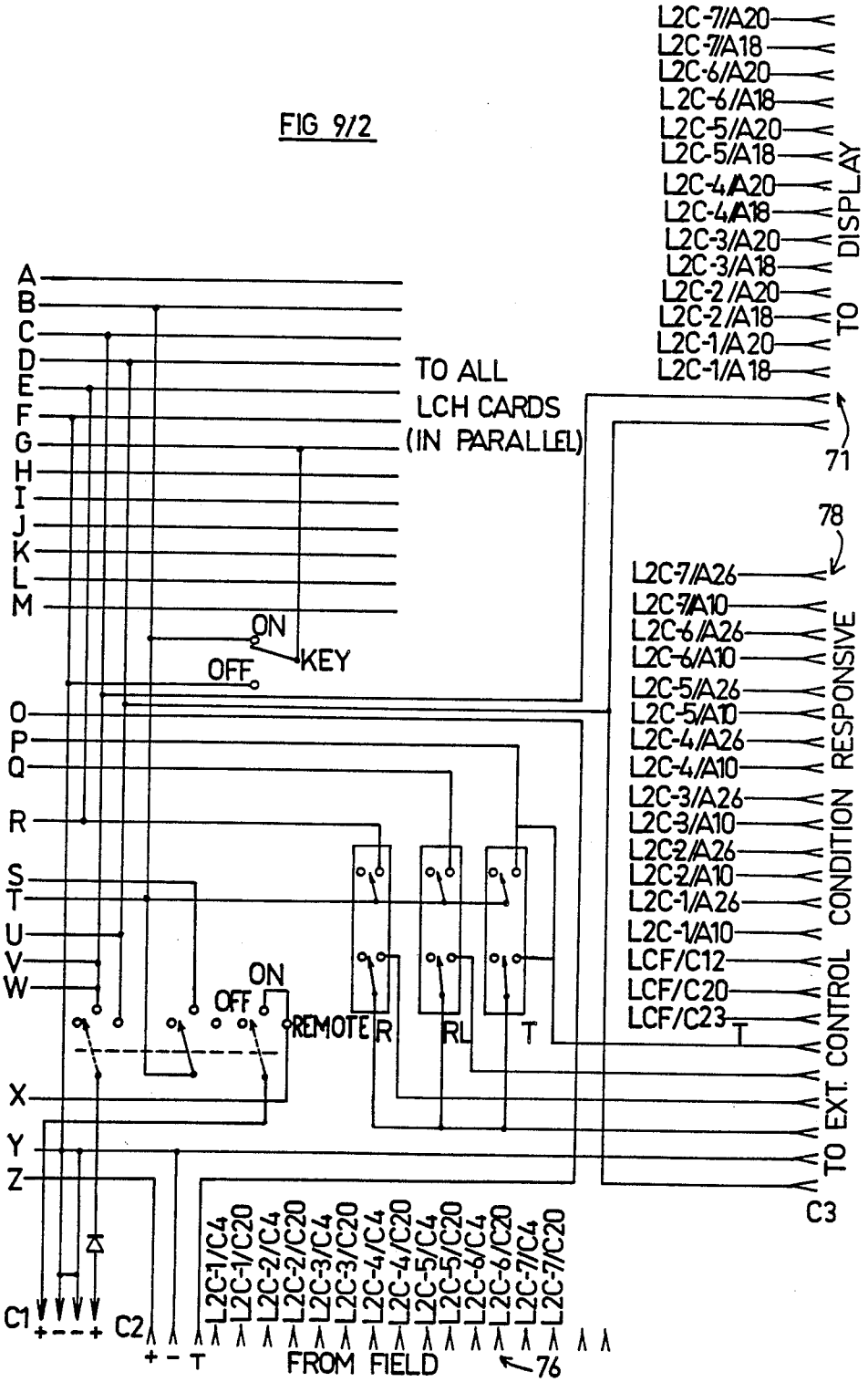

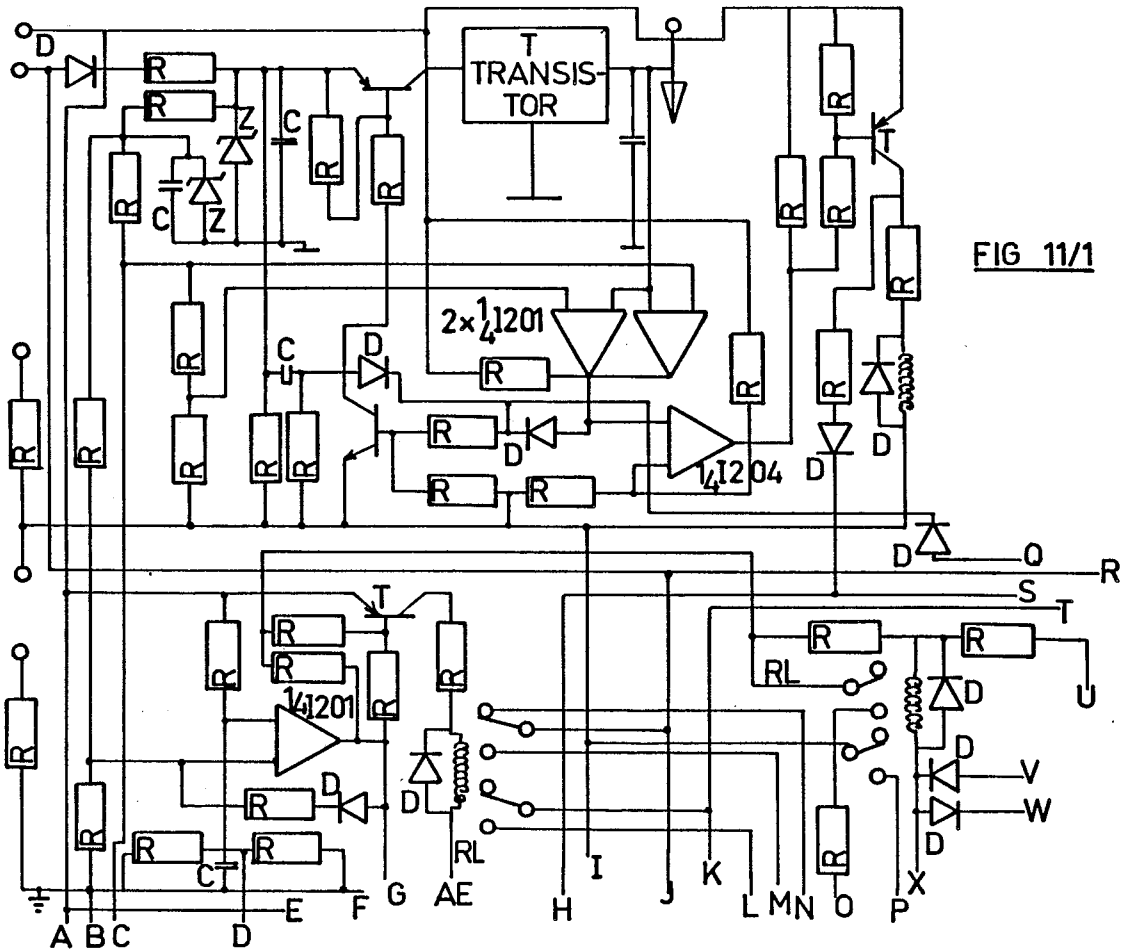
FIG 11/1

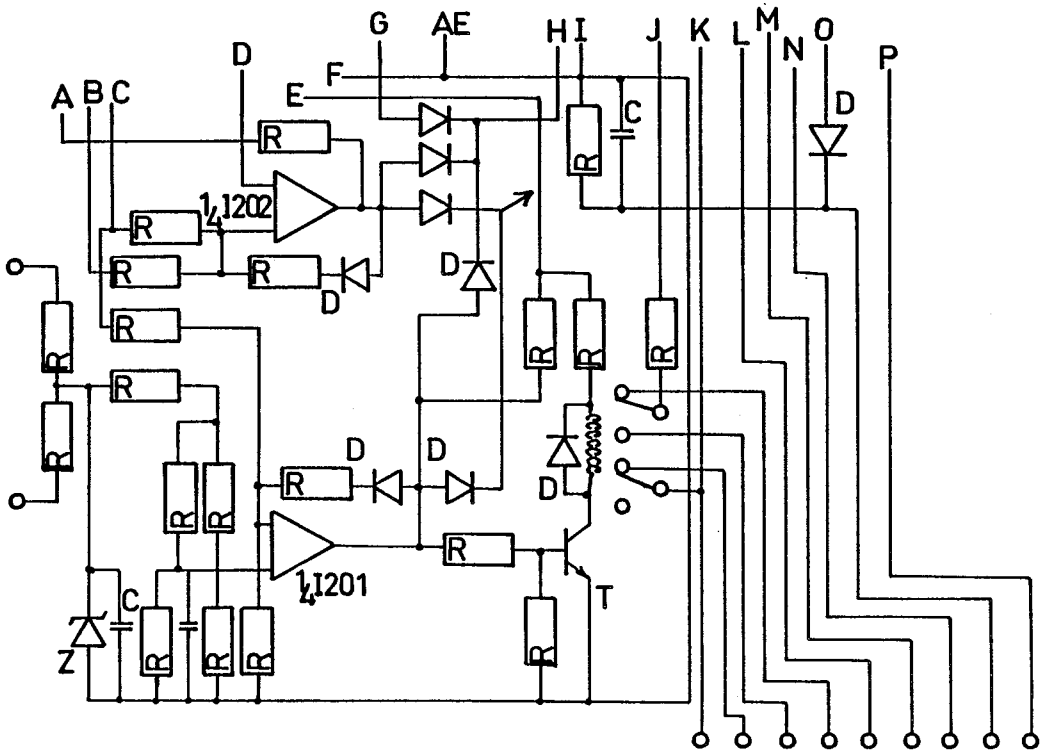
FIG 11/2

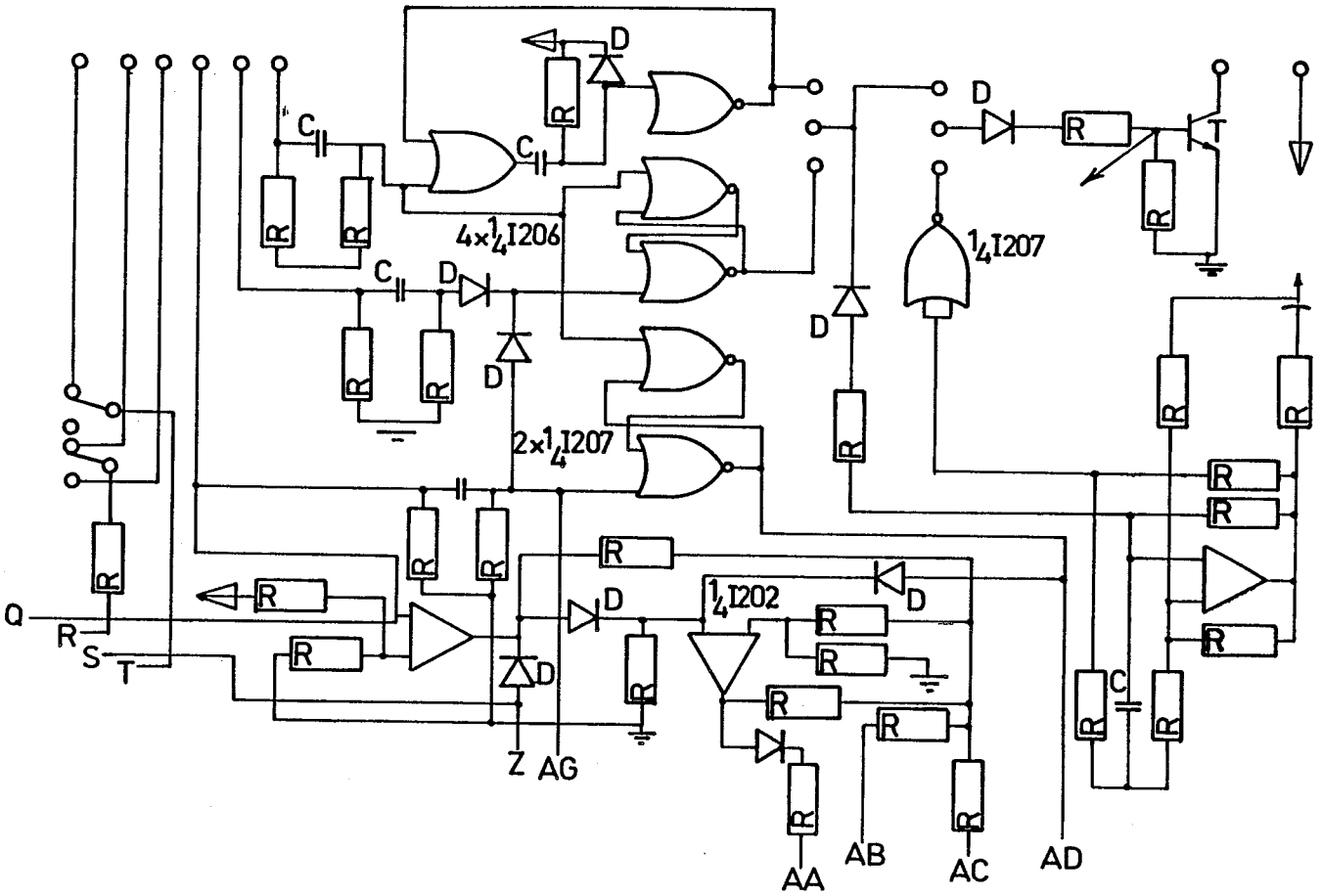
FIG 11/3

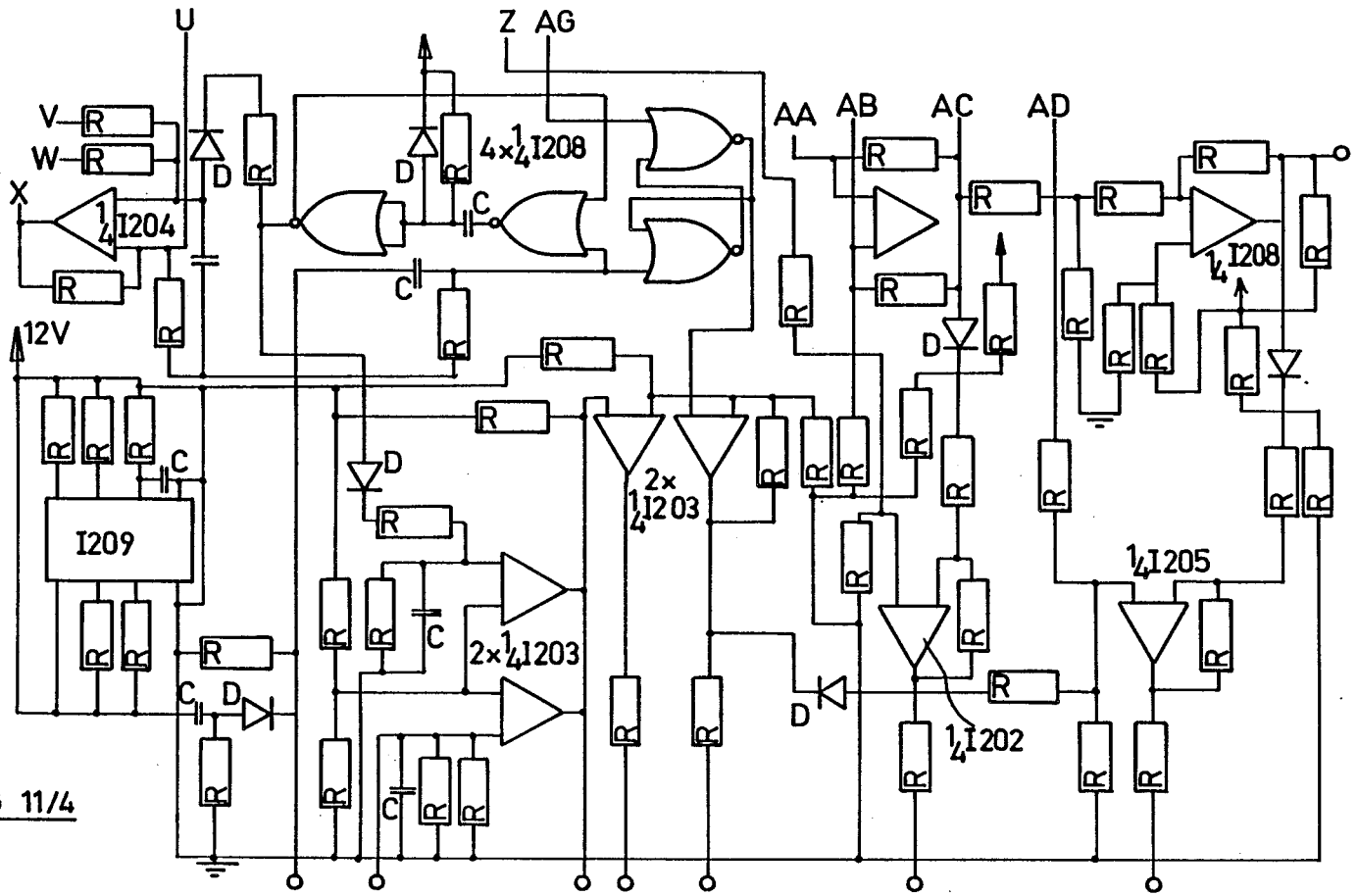
FIG 11/4

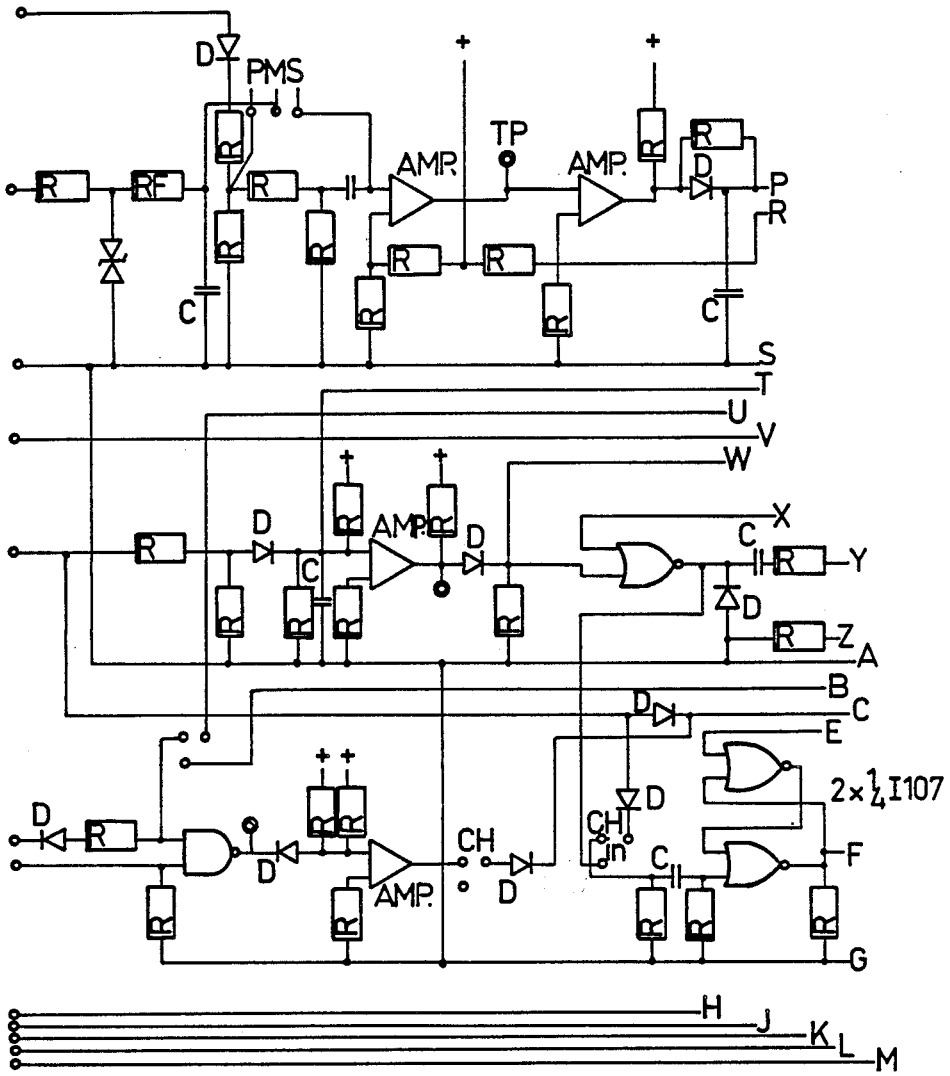
FIG 13/1

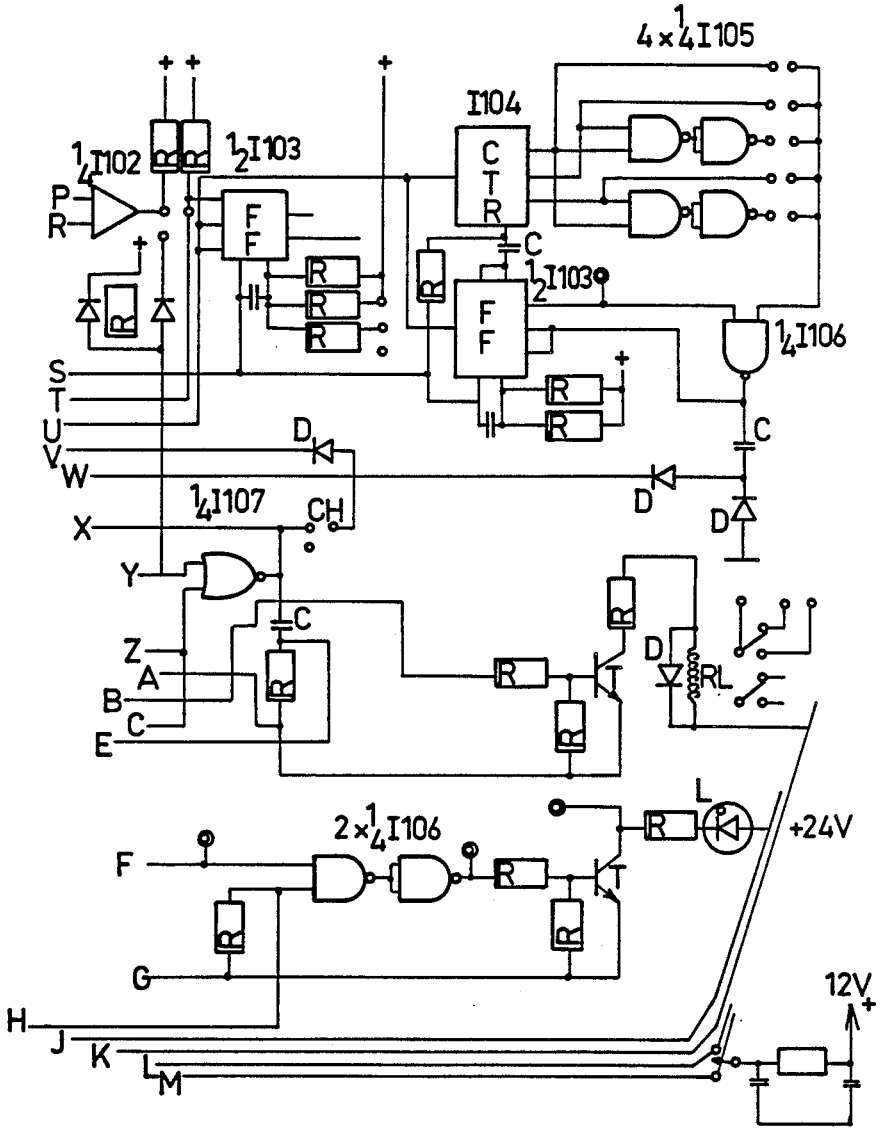
FIG 13/2

PERIMETER SURVEILLANCE SYSTEM WITH SECTIONAL INHIBITION

FIELD OF THE INVENTION

The present invention relates to intrusion detection systems generally and more particularly to concealed perimeter surveillance systems based on magnetic anomaly detection.

BACKGROUND OF THE INVENTION

Concealed perimeter surveillance systems employing magnetic anomaly detection are known in the art. Such systems typically comprise a plurality of sensors, typically in the form of buried wire loops, which are connected individually to a central control and display console, which indicates the location of an intrusion.

In order to avoid false alarms due to spurious electromagnetic interference, as from power lines, conventional systems are provided with inhibition apparatus which prevents an alarm indication during the presence of such interference anywhere in the system.

SUMMARY OF THE INVENTION

The present invention seeks to provide an improved perimeter surveillance system providing enhanced protection at lower cost than conventional systems of the type described hereinabove.

There is thus provided in accordance with a preferred embodiment of the present invention as improved perimeter surveillance system comprising a plurality of intrusion sensors distributed in the field, amplifier apparatus associated with the plurality of intrusion sensors and apparatus for inhibiting an alarm indication output of amplifier apparatus associated with an intrusion sensor in response to simultaneously detected electromagnetic interference detected thereat, without necessarily inhibiting the operation of other amplifier apparatus in the system.

Additionally in accordance with a preferred embodiment of the invention, the intrusion sensors are buried wire loop sensors.

Further in accordance with an embodiment of the present invention, the amplifier apparatus associated with each intrusion sensor is operative to activate auxiliary apparatus, such as searchlights, cameras and audio alarms in response to sensed intrusion at said intrusion sensor.

Further in accordance with a preferred embodiment of the present invention, additional intrusion sensors are connected in series with the aforesaid intrusion sensors, to define additional protection in given intrusion zones.

Additionally in accordance with a preferred embodiment of the present invention there is provided insulation between the amplifier apparatus and the earth to prevent false alarms due to earth fields.

BRIEF DESCRIPTION OF THE DRAWINGS

The present invention will be understood and appreciated more fully from the following detailed description taken in conjunction with the drawings in which:

FIG. 9 is a diagram of the control center employed in a preferred embodiment of the invention;

FIG. 11 is a schematic illustration of the circuitry of FIG. 10;

FIG. 13 is a schematic illustration of the circuitry of FIG. 12;

DETAILED DESCRIPTION OF THE INVENTION

Figure 1:
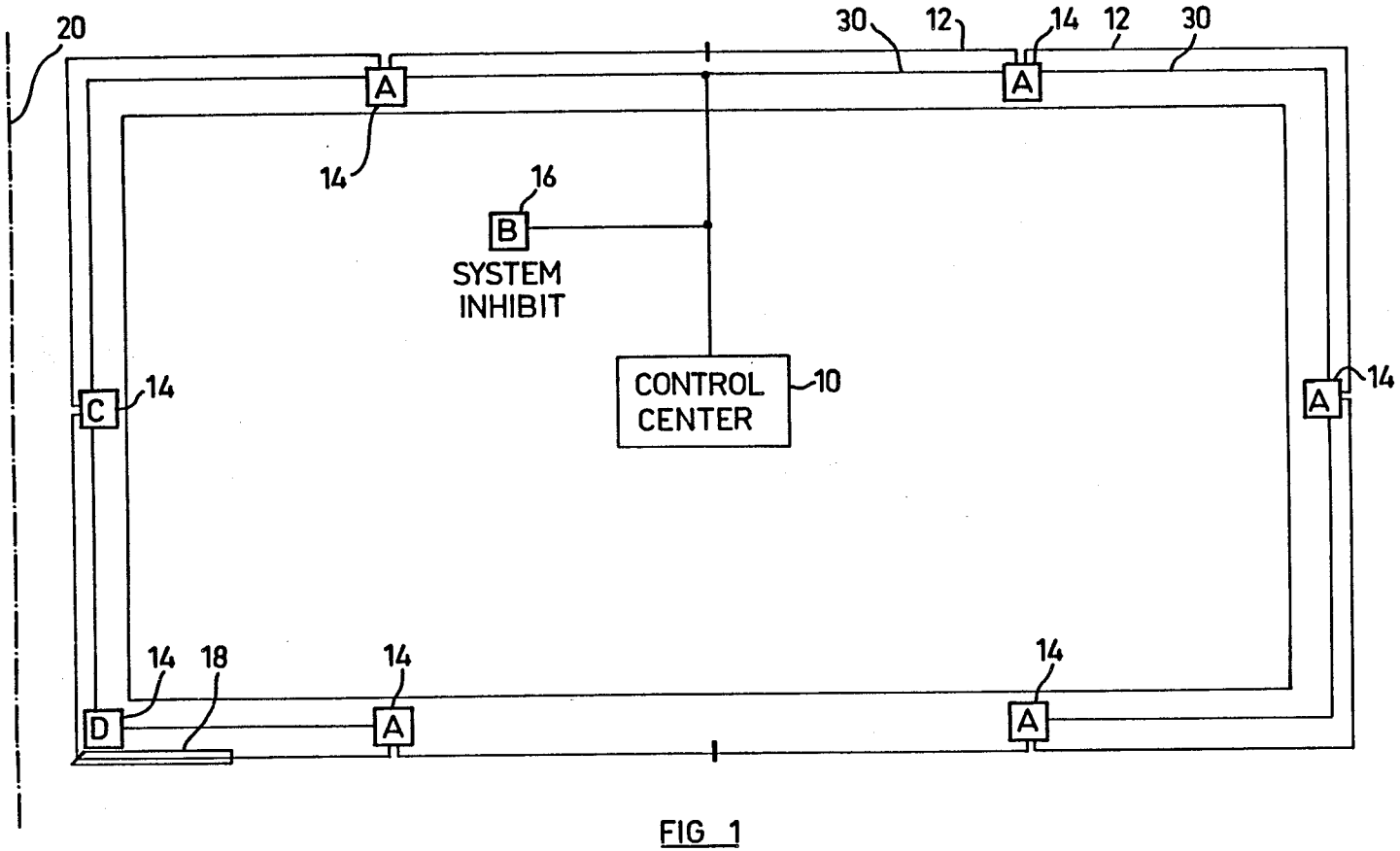
FIG. 1 is an illustration of a typical site layout for an intrusion detection system constructed and operative in accordance with a preferred embodiment of the present invention.

Reference is now made to FIG. 1, which shows a typical site layout for an intrusion detection system constructed and operative in accordance with a preferred embodiment of the present invention. The intrusion detection system typically comprises a control center 10 which monitors the operation of the entire systems and displays intrusions through a predetermined periphery along which the system is disposed.

Along the predetermined periphery there are disposed a plurality of sensors 12, typically defined by buried wire loops, which are described hereinafter in connection with FIGS. 2 and 3. Each sensor 12 is typically connected to an amplification-local inhibition assembly 14. A number of different types of assembly configurations are employed in the system and are indicated by letters A, C and D. These are described hereinbelow with reference to FIGS. 4, 5 and 6 respectively.

A system inhibit circuit is provided and indicated at reference numeral 16 by letter B. An auxiliary sensor 18 may be provided at one or more locations along the periphery and is shown connected to assembly type D. For the purpose of explanation, a source of interference, such as a high tension electrical transmission wire, is indicated at reference numeral 20.

Figure 2:
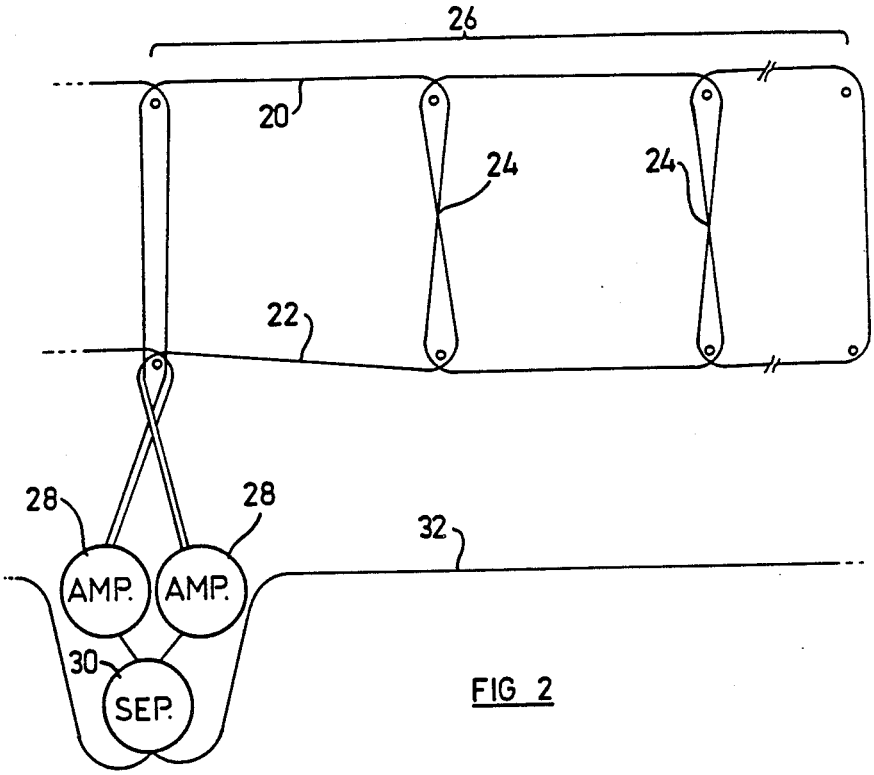
FIG. 2 is an illustration of the arrangement of the wire loop sensors and associated amplifiers and separators employed in accordance with the present invention.

Reference is now made to FIG. 2, which illustrates a portion of an intrusion sensor 12, as seen typically in a plane parallel to the ground surface. The intrusion sensor 12 is disposed below the ground surface and is provided with conductors typically disposed as illustrated in a multiple loop configuration which is designed to minimize false alarms. The intrusion sensor is characterized by a repeating pattern of conductor pairs, each of length up to about 20 meters wherein parallel conductors 20 and 22 extend between crossover loops 24. The separation of parallel conductors 20 and 22 is typically up to 1.5 meters.

A plurality of conductor pairs defines a sector 26, which is typically of overall length of up to 500 meters. Each sector 26 corresponds to a sensor 12, shown in FIG. 1, and is connected to an amplifier 28. Amplifier 28 is output coupled to a separator 30 and thence to a control cable 32 which leads to control center 10. It is noted that it is not necessary for an even number of sectors 26 to be defined in a system.

Figure 3:
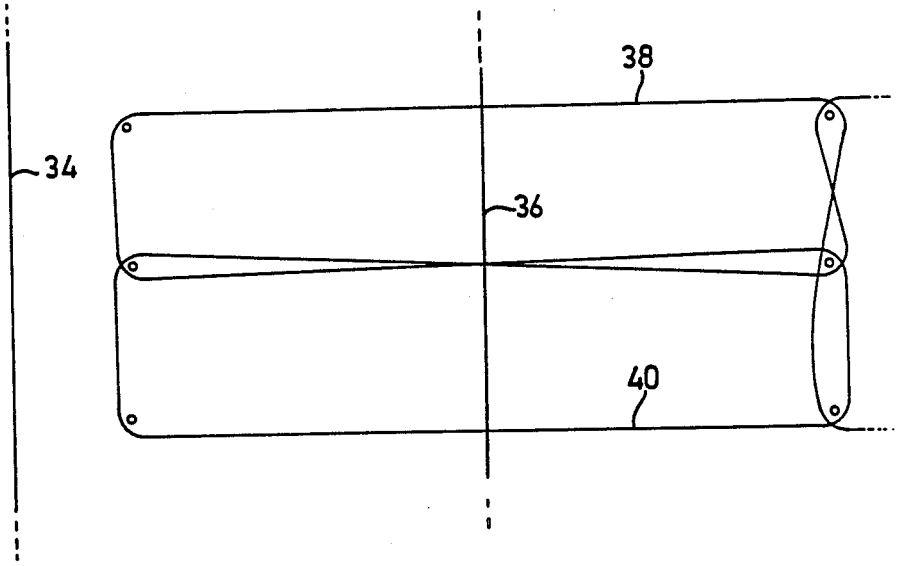
FIG. 3 is an illustration of an interference resistant loop employed in the presence of a source of electromagnetic interference.

Reference is now made to FIG. 3 which illustrates a particular loop arrangement which provides reduced interference from elongate sources of electrical interference 34 and 36, such as electrical power transmission lines, which lie at 90 degrees to the orientation of parallel conductors 38 and 40. It is seen that the loop configuration of FIG. 2 is further subdivided as illustrated, perpendicular to the longitudinal axes of the elongated sources 34 and 36, to provide the desired balancing.

Figure 4:
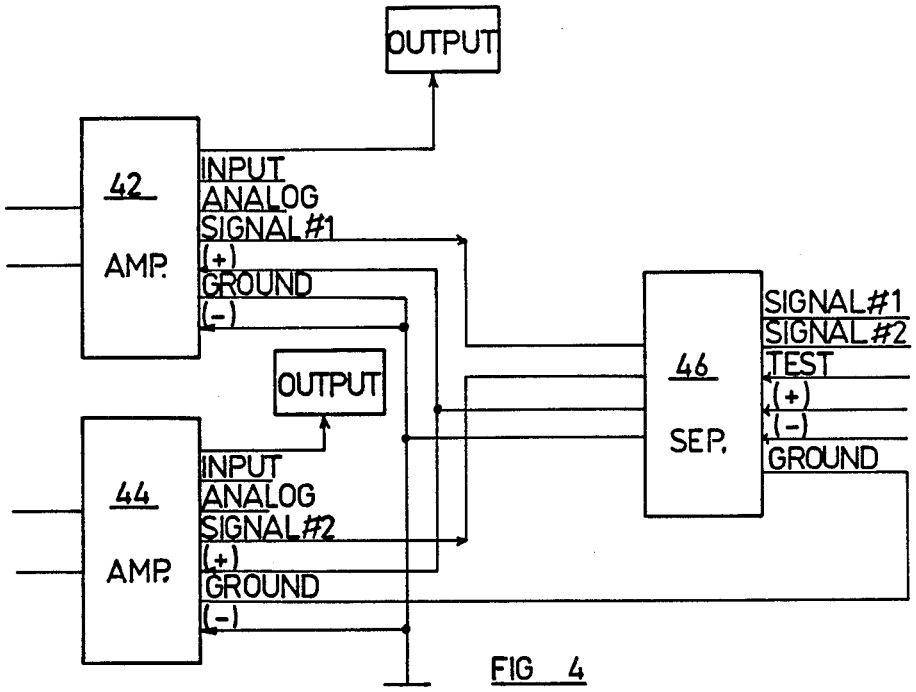
FIGS. 4, 5 and 6 are block diagram illustrations of three typical types of amplifier connections employed in accordance with the present invention.

Reference is now made to FIG. 4 which illustrates, in block diagram form, the A type of amplifier-separator interconnections employed in the system of FIG. 1. Here a pair of identical amplifiers 42 and 44 are provided, each having the following terminals: output, input, analog, signal, +, ground and −, in addition to the sensor connections which are connected to a sector 26. Amplifiers 42 and 44 are illustrated in detailed schematic illustration in FIGS. 14–16. The output connections may be employed for operating auxiliary equipment such as searchlights.

Figure 17:
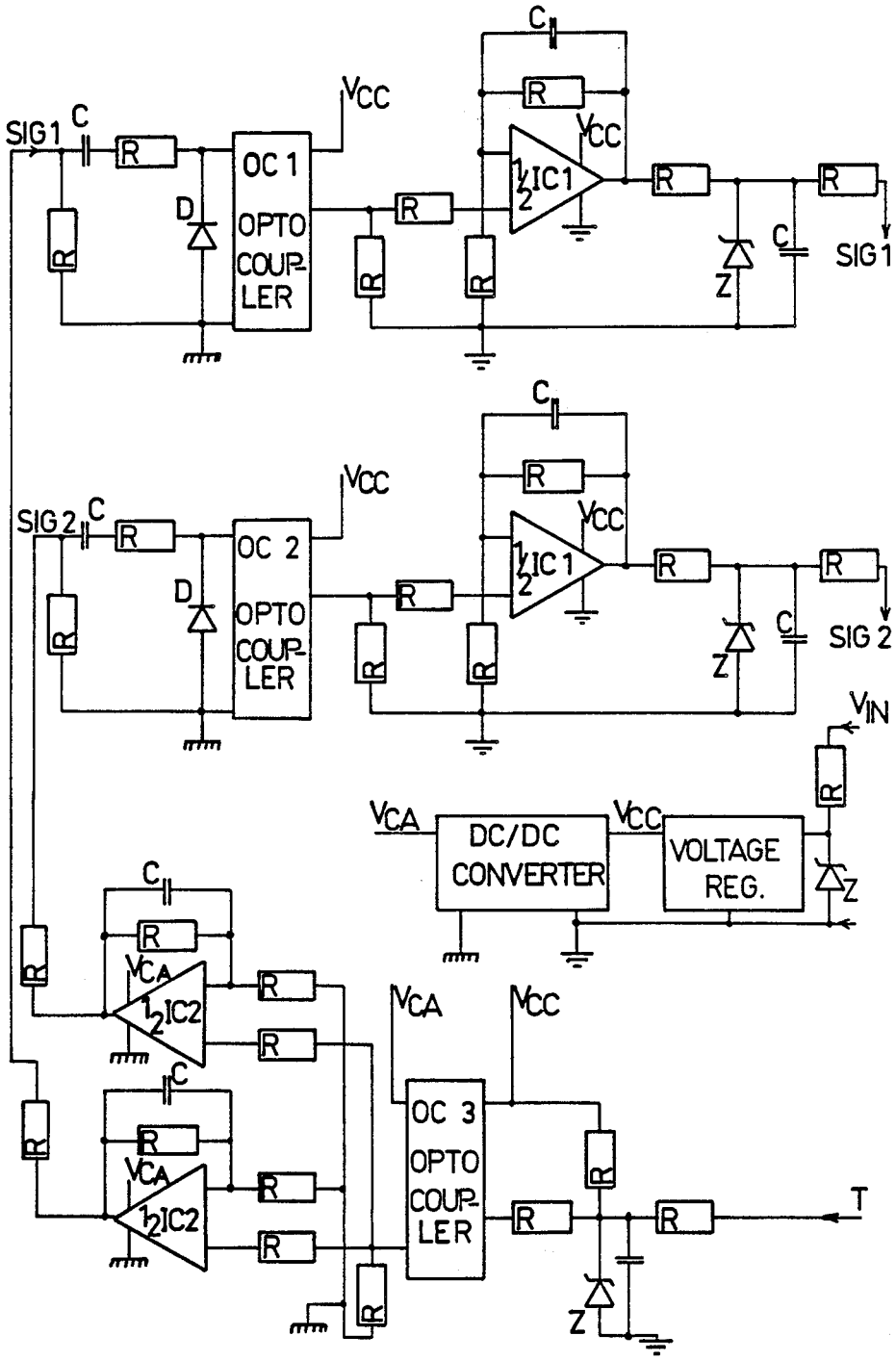
FIG. 17 is a schematic illustration of a separator employed in the embodiment of FIG. 4.

The +, −, and ground signal terminals of the two amplifiers are coupled to a separator 46, such as that shown in FIG. 17, typically including an optoisolator for isolating the various signals and a DC-DC converter for isolating the input and output voltages. The signal outputs of both amplifiers are supplied via the separator 46 through the control cable 32 (FIG. 1) as are the +, − and ground connections to the control center 10.

Figure 5:
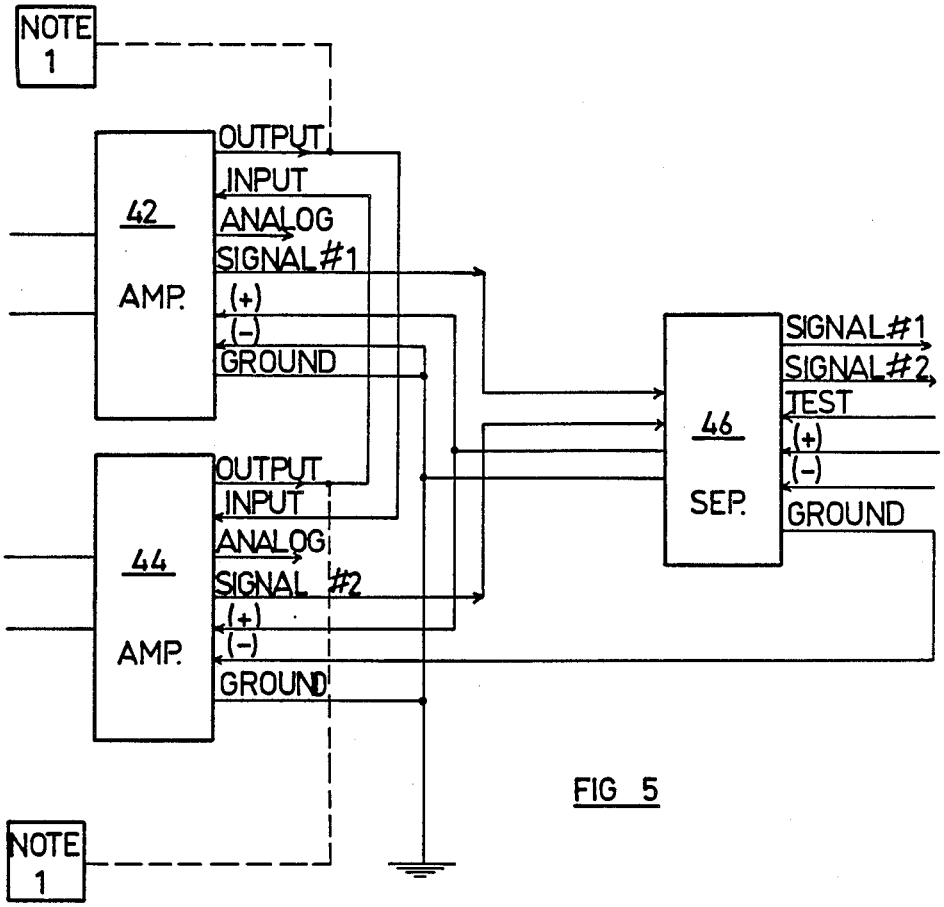

FIG. 5 illustrates the C type of amplifier-separator interconnections. This configuration is identical to that of FIG. 4 except that here, in accordance with a preferred embodiment of the invention, local inhibition is provided by coupling the output of amplifier 42 to the input of amplifier 44 and vice versa. As a result, should both amplifiers receive the same signal simultaneously to within a predetermined threshold, no indication of change is provided at the input and output of separator 46, since the net output of each amplifier remains the same. In this manner, local interference at a given pair of sectors 26 (FIG. 2) is dealt with by local inhibition without interfering with the normal operation of the remaining sectors of the system.

Figure 6:
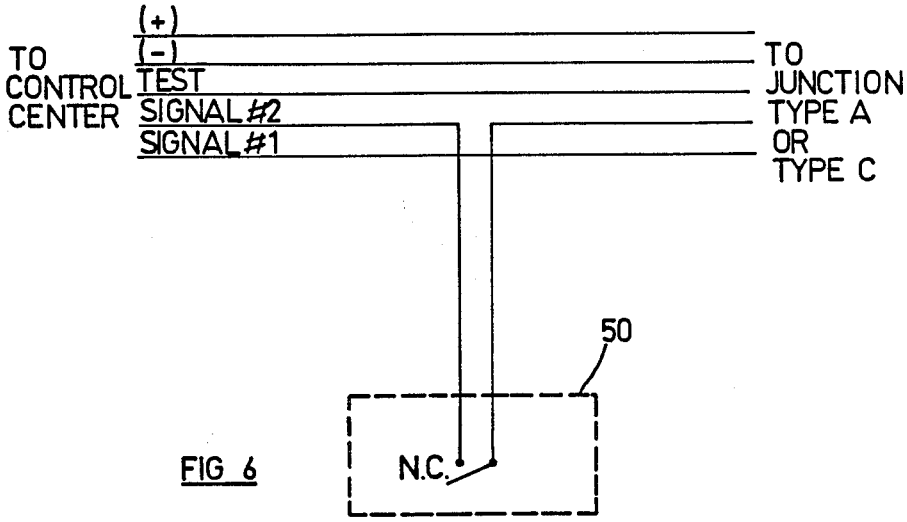

Reference is now made to FIG. 6 which illustrates a connection of the D type wherein another type of sensor 50, such as a taut wire sensor, for example, is connected in series along the control cable 32, specifically in series along one of the two signal outputs extending from a type A or C connection to the control center 10.

Figure 7:
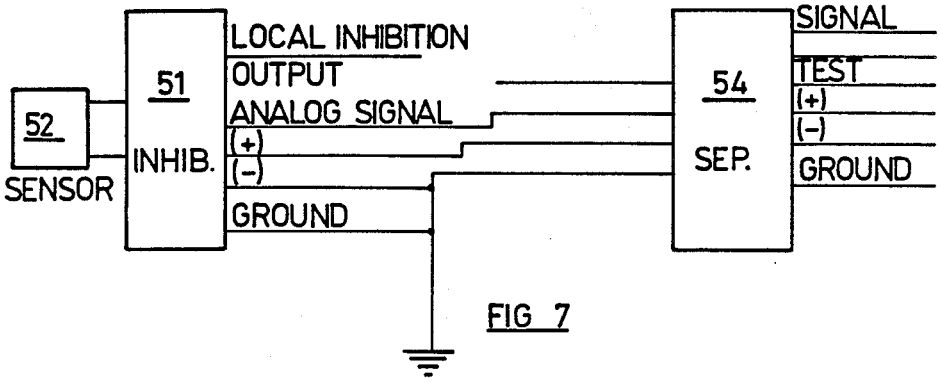
FIG. 7 is a block diagram illustration of an interconnection between an inhibitor and a separator employed in the layout shown in FIG. 1.
Figure 16:
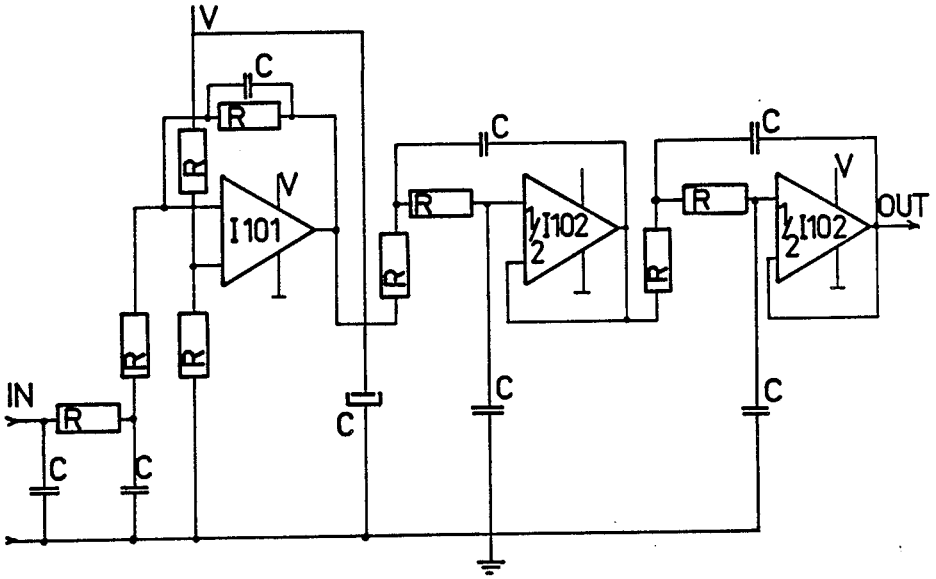
FIGS. 14–16 are schematic illustrations of the amplifier/inhibitor shown in block diagram form in FIG. 8.
Figure 14:
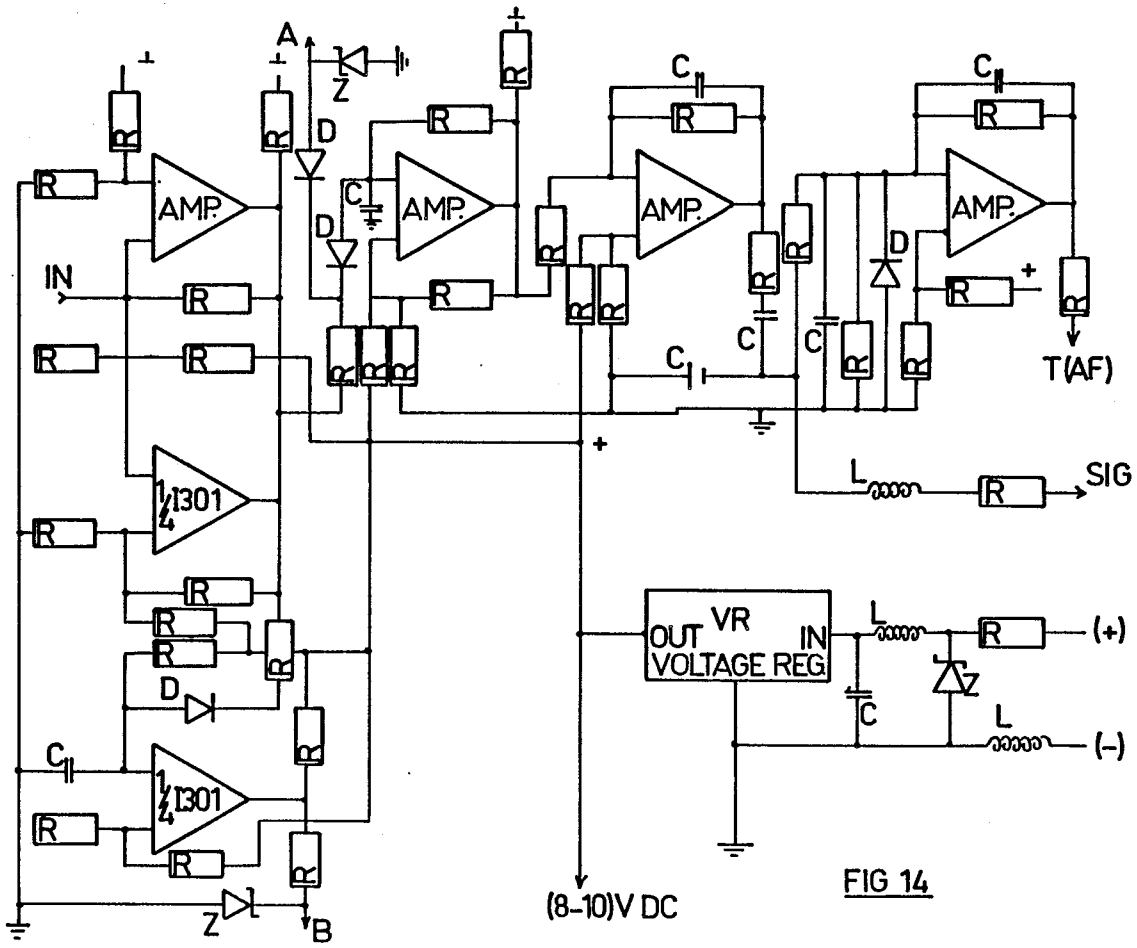
Figure 15:
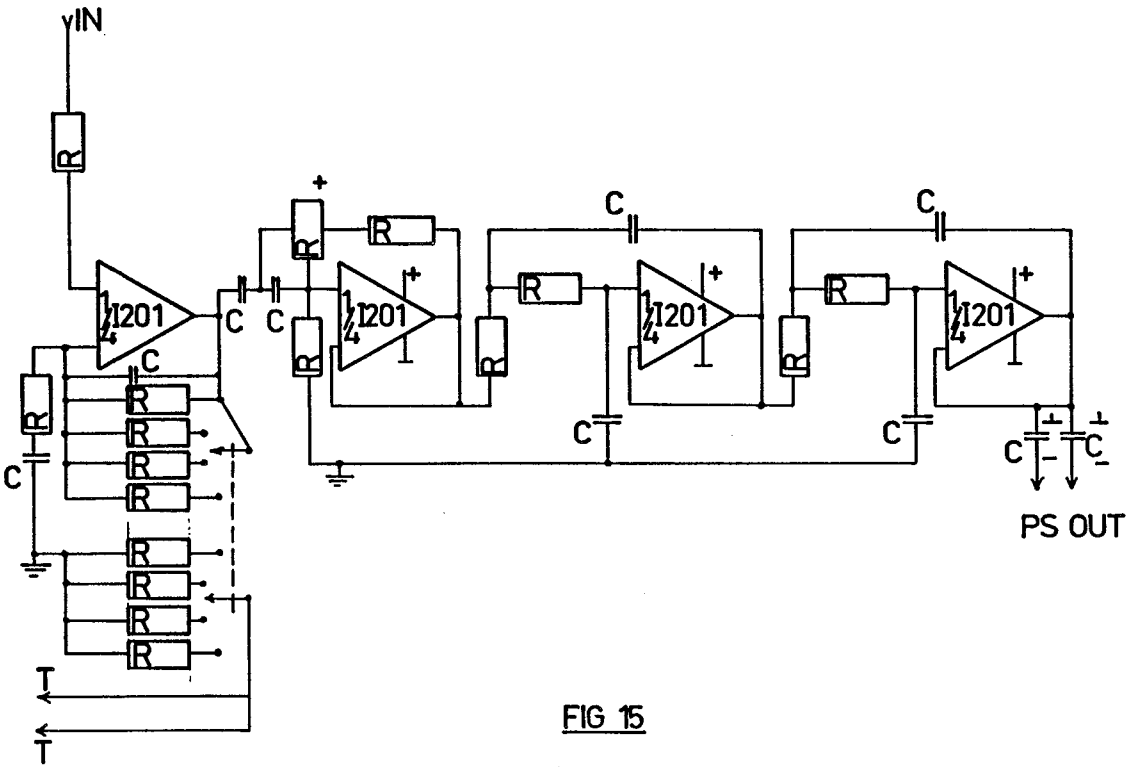

FIG. 7 illustrates a type B connection wherein an inhibitor 51, such as that shown in FIGS. 14–16 receives a disturbance input, typically of a system wide nature, such as lightening, from a disturbance sensor 52, such as a closed circuit antenna. The inhibitor 51 is typically connected to a control cable 32 via a separator 54, which may be identical to separator 46 (FIG. 4) and normally provides a system inhibit output to the control center 10 via the control cable 32. Alternatively, it may provide a local inhibition output to one or more specific sectors.

Figure 8:
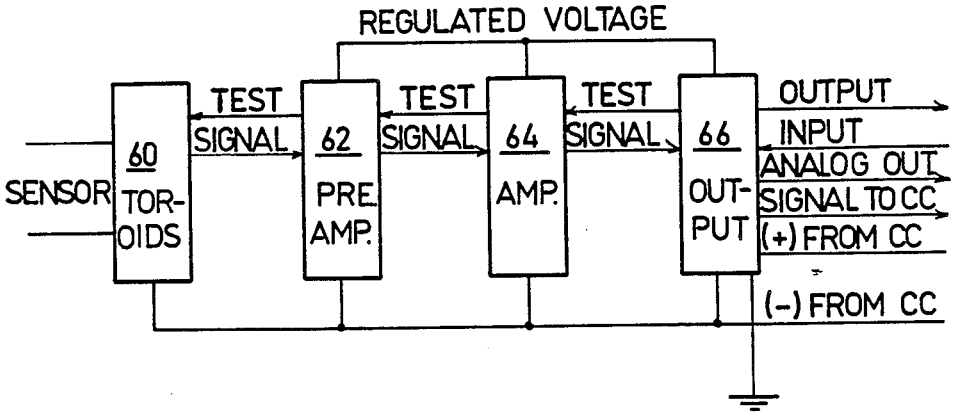
FIG. 8 is a block diagram of an amplifier and inhibitor employed in the invention.

Reference is now made to FIG. 8 which is a block diagram illustration of the amplifier and inhibitor employed in the embodiments of the invention and referred to variously by reference numerals 42, 44 and 51, it being understood that the amplifier and inhibitor may be identical.

The amplifier/inhibitor illustrated in FIG. 8 comprises toroids 60 which are coupled to a sensor sector 26 (FIG. 2). The toroids are interconnected with a preamplifier 62 which outputs to an amplifier filter 64 which outputs via a power supply and output circuit 66. The circuitry of FIG. 8 is illustrated in detail in the schematic illustrations of FIGS. 14–16.

FIG. 9 illustrates, in wiring diagram form, the control center 10 employed in the embodiment of FIG. 1. The control center typically comprises LCC circuitry 70 which is coupled to a plurality of LCH circuits 72, the connections to one of the LCC circuits being shown. Connections to a display are indicated at reference numeral 74, while inputs from the various sectors are indicated at reference numeral 76. External outputs to auxiliary apparatus such as searchlights, etc. are indicated at reference numeral 78.

Figure 10:
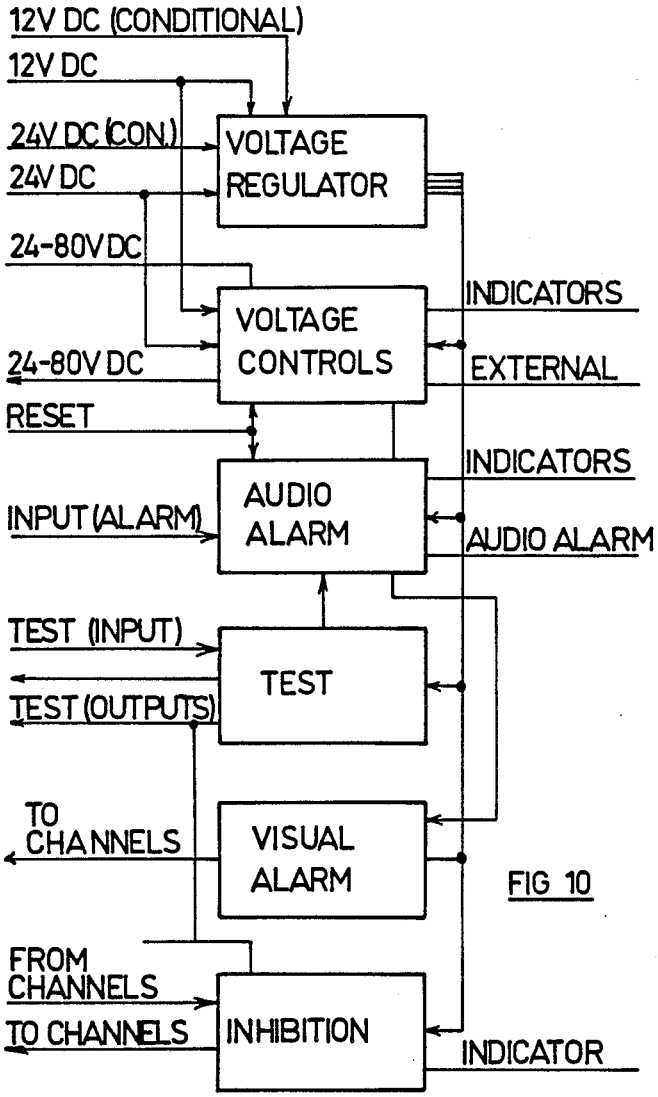
FIG. 10 is a block diagram of common card ("LCC") circuitry employed in the invention.
Figure 12:
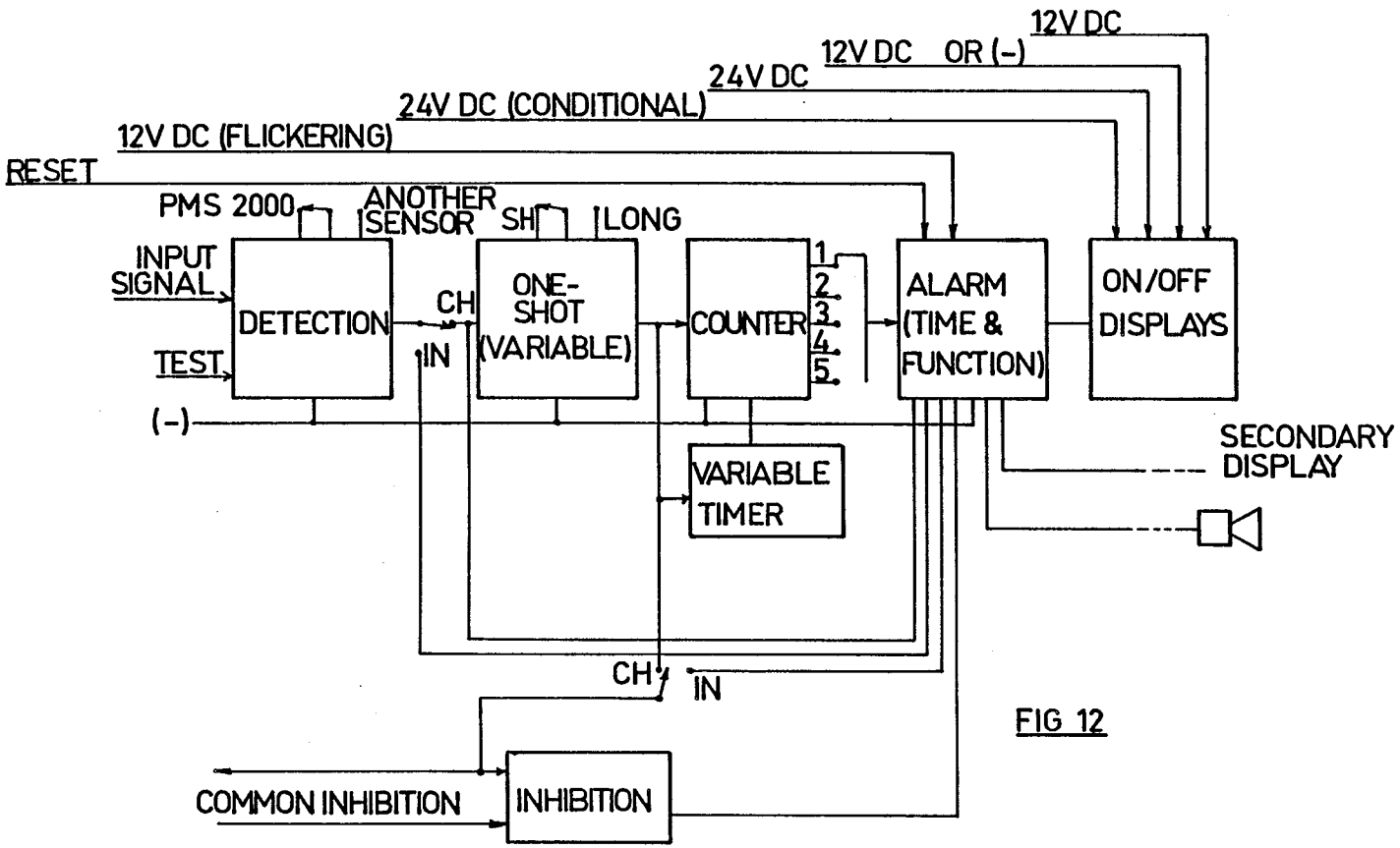
FIG. 12 is a block diagram of channel circuit ("LCH") circuitry employed in the invention.

The LCC circuitry 72 is illustrated in block diagram form in FIG. 10 and in detailed schematic form in FIG. 11. The LCH circuitry is illustrated in block diagram form in FIG. 12 and in detailed schematic form in FIG. 13.

It will be appreciated by persons skilled in the art that the present invention is not limited by what has been particularly shown and described herein. Rather the scope of the present invention is defined only by the claims which follow:

We claim:

1. An improved perimeter surveillance system comprising:

a plurality of intrusion sensors distributed in a region to be protected;

respective amplifier means associated with said plurality of intrusion sensors; and means for inhibiting an alarm indication output of an amplifier means associated with an intrusion sensor in response to simultaneous detection of electromagnetic interference detected thereat, without inhibiting the operation of other amplifier means in the system.

2. Apparatus according to claim 1 and wherein said intrusion sensors comprise buried wire loop sensors.

3. Apparatus according to claim 2 and wherein said amplifier means associated with each intrusion sensor is operative to activate auxiliary apparatus, such as searchlights, cameras and audio alarms in response to sensed intrusion at said intrusion sensor.

4. Apparatus according to claim 2 and wherein additional intrusion sensors are connected in series to the buried wire loop sensor so as to define additional protection in given intrusion zones.

5. Apparatus according to claim 2 and also comprising means for providing shielding between the amplifier means and the earth to prevent false alarms due to earth fields.

6. Apparatus according to claim 1 and wherein said amplifier means associated with each intrusion sensor is operative to activate auxiliary apparatus, such as searchlights, cameras and audio alarms in response to sensed intrusion at said intrusion sensor.

7. Apparatus according to claim 1 and also comprising means for providing shielding between the amplifier means and the earth to prevent false alarms due to earth fields.

* * * * *